US005897238A

United States Patent [19]

Hockey et al.

[11] Patent Number: 5,897,238

[45] Date of Patent: Apr. 27, 1999

[54] METHOD OF SETTING POSITION OF A CORONA CHARGER

[75] Inventors: David E. Hockey, Brockport; George R. Walgrove, Rochester, both of N.Y.

[73] Assignee: Eastman Kodak Company, Rochester, N.Y.

[21] Appl. No.: 09/099,629

[22] Filed: Jun. 18, 1998

[51] Int. Cl.[6] ..... G03G 15/02

[52] U.S. Cl. ..... 399/50; 399/171; 399/85; 250/324; 250/325; 361/225

[58] Field of Search ..... 399/50, 171, 172, 399/170, 85; 250/324–326; 361/225

[56] References Cited

U.S. PATENT DOCUMENTS

| | | | |
|---|---|---|---|
| 3,800,153 | 3/1974 | Matsumoto et al. | 250/325 |
| 3,937,960 | 2/1976 | Matsumoto et al. | 250/326 |
| 4,183,655 | 1/1980 | Umahashi et al. . | |
| 4,320,957 | 3/1982 | Brown et al. . | |
| 4,456,825 | 6/1984 | Kuge et al. | 250/324 |
| 4,473,029 | 9/1984 | Fritz et al. . | |
| 4,546,060 | 10/1985 | Miskinis et al. . | |
| 4,607,941 | 8/1986 | Honda . | |
| 4,623,243 | 11/1986 | Iijima et al. . | |
| 5,258,782 | 11/1993 | Ochiai . | |
| 5,324,942 | 6/1994 | Mishra et al. | 250/326 |

OTHER PUBLICATIONS

Patent Abstracts of Japan, vol. 6, No. 248 GRP No. P160 for doc No. 57–146275, Dec. 7, 1982.

*Primary Examiner*—Richard Moses
*Attorney, Agent, or Firm*—Norman Rushefsky

[57] ABSTRACT

A setup method for a corona charger device used in an electrophotographic recording apparatus. The setup method includes operating the corona charger device in a calibration mode so that charge of a first polarity is output by the device and deposited upon a photoconductive recording member. The level of charge deposited upon the member is sensed and a position of the charger device relative to the member is adjusted so that the level of charge deposited upon the member is at a target level. The charge of the first polarity output for setup is opposite to that of charge output during the production run.

8 Claims, 3 Drawing Sheets

METHOD OF SETTING POSITION OF A CORONA CHARGER

FIELD OF THE INVENTION

This invention relates to a method of setup of a corona charger in an electrophotographic reproduction apparatus and more particularly, to an improved method for setting up a corona charger that charges a photoconductor in the opposite polarity of its normal operating polarity.

BACKGROUND OF THE INVENTION

Electrophotographic printers and copiers commonly use composite photoconductors as the means to create latent electrostatic images. Composite photoconductors have a photosensitive layer (charge generation layer or CGL) and a charge transport layer (CTL). The CGL is able to generate a hole/electron pair and can transport charges of both polarities. The CTL layer is normally designed such that it will only transport one charge species (only negative or only positive charge carriers) to provide stability. Due to the fact that the CTL can transport only one species of charge carrier, a composite design results in a photoconductor that is meant to be useful for creating latent images when the surface is charged in the intended polarity. If the photoconductor is charged in the opposite polarity and then exposed to light, charges may become trapped in the photoconductor structure. These trapped charges result in poor performance or permanent damage of the photoconductor.

It is common in electrophotographic systems to have functions that require the surface of the photoconductor to be charged in the polarity opposite to that with which they are designed to be used. One such function is the corona charger that conditions the photoconductor prior to the photoconductor cleaning apparatus. The charger must charge the photoconductor and the residual toner left on the photoconductive member after image transfer to a level to facilitate removal of the residual toner. Another example of a function that requires the use of a charger of the opposite polarity is the transfer charger in a Discharge Area Development (DAD) device. DAD electrophotographic printers make use of toners that charge in the same polarity in which the photoconductive member is light sensitive. A charger of opposite polarity is required in the transfer function to cause the toned image to migrate to the receiver member.

To simplify the description of this invention, we will assume that the composite photoconductor in use is designed with a hole transport CTL. In this case, the film is designed to be charged negatively. A corona charger operating in the positive mode with such a photoconductor would benefit from use of this invention. The discussion could be applied to a positive charging photoconductor by changing all the references to negative charging to positive charging and visa versa.

Corona chargers in electrophotographic devices need to be spaced accurately from the photoconductive member to assure that uniform charge is applied to the photoconductor surface. It is common to have an adjustment feature designed into the corona charger to facilitate setting up a precise spacing between the charger and the surface of the photoconductive member. The uniformity of the charge laid down on the photoconductive member is measured by the use of an electrostatic voltmeter. The spacing of the corona charger to the photoconductive member is varied until a uniform charge is obtained. To assure consistent charging of the photoconductive member, it is required that the charge is erased after being measured by the electrostatic voltmeter.

The use of erasure assures that a consistent charge level is on the photoconductive member as it enters the corona charger that is being set up.

The setup of a corona charger which charges the photoconductor in the negative polarity is straight forward. The photoconductor is charged by the corona charger to be adjusted, measured by an electrostatic voltmeter, and then erased by an exposure device to return the film to a stable level. Setup of chargers in an electrophotographic system which charges the photoconductive member in the positive polarity is more difficult. This is due to the fact that if the photoconductor is charged in the positive polarity the charge cannot be erased by an exposure device.

In systems that require the setup of a charger that operates in the positive polarity, use of an additional charging device which charges the photoconductive member to the negative polarity is commonly used. Normally the primary charger is used to accomplish this function. This charger reverses the charge level on the photoconductive member, allowing the photoconductor to be erased with an exposure device without damaging the photoconductor from trapped charge in the photoconductive layer or layers. This provides a stable input voltage for the positive charger being adjusted for uniformity.

The use of this method has some drawbacks. This method requires that either:

1. The electrostatic voltmeter probe be placed between the charger being setup and the charger that returns the photoconductive member to the negative polarity. This is often inconvenient and results in the need to facilitate multiple positions to locate the electrostatic voltmeter probe depending on the charger being setup, or
2. An algorithm be provided that cycles the negative charger, that returns the photoconductive member to the negative polarity, off and on precisely. The readings for the positive charger being set up in the positive polarity are taken for one revolution, then the photoconductive member is charged to the negative polarity by the negative charger and erased. The cycle can then begin again.

SUMMARY OF THE INVENTION

It is an object of the invention to overcome the noted drawbacks.

In accordance with the invention there is provided a method for use in an electrophotographic recording apparatus having a photoconductive recording member. The method comprises operating a corona charger device in a calibration mode so that charge of a first polarity is output by the device and deposited upon the member. The level of charge deposited upon the member is sensed. A position of the device relative to the member is adjusted so that the level of charge deposited upon the member is at a target level. During a production run mode the corona charger device is operated so that a charge of a second polarity, opposite to that of the first polarity is output by the device deposited upon the member or a receiver sheet in engagement with the member.

DETAILED DESCRIPTION OF THE INVENTION

The present invention is described below in the environment of a particular electrophotographic copier and/or printer. However, it will be noted that although this invention is suitable for use with such machines, it also can be used with other types of electrophotographic copiers and printers.

Because apparatus of the general type described herein are well known the present description will be directed in particular to elements forming part of, or cooperating more directly with, the present invention.

To facilitate understanding of the foregoing, the following terms are defined:

$V_B$=Development station electrode bias.

$V_O$=Primary voltage (relative to ground) on the photoconductor as measured just after the primary charger. This is sometimes referred to as the "initial" voltage.

$E_O$=Light produced by the printhead to form a discharged area on the photoconductor needed to produce a density $D_{MAX}$ or a control parameter such as current to the printhead to generate a density $D_{MAX}$.

Figure 1:
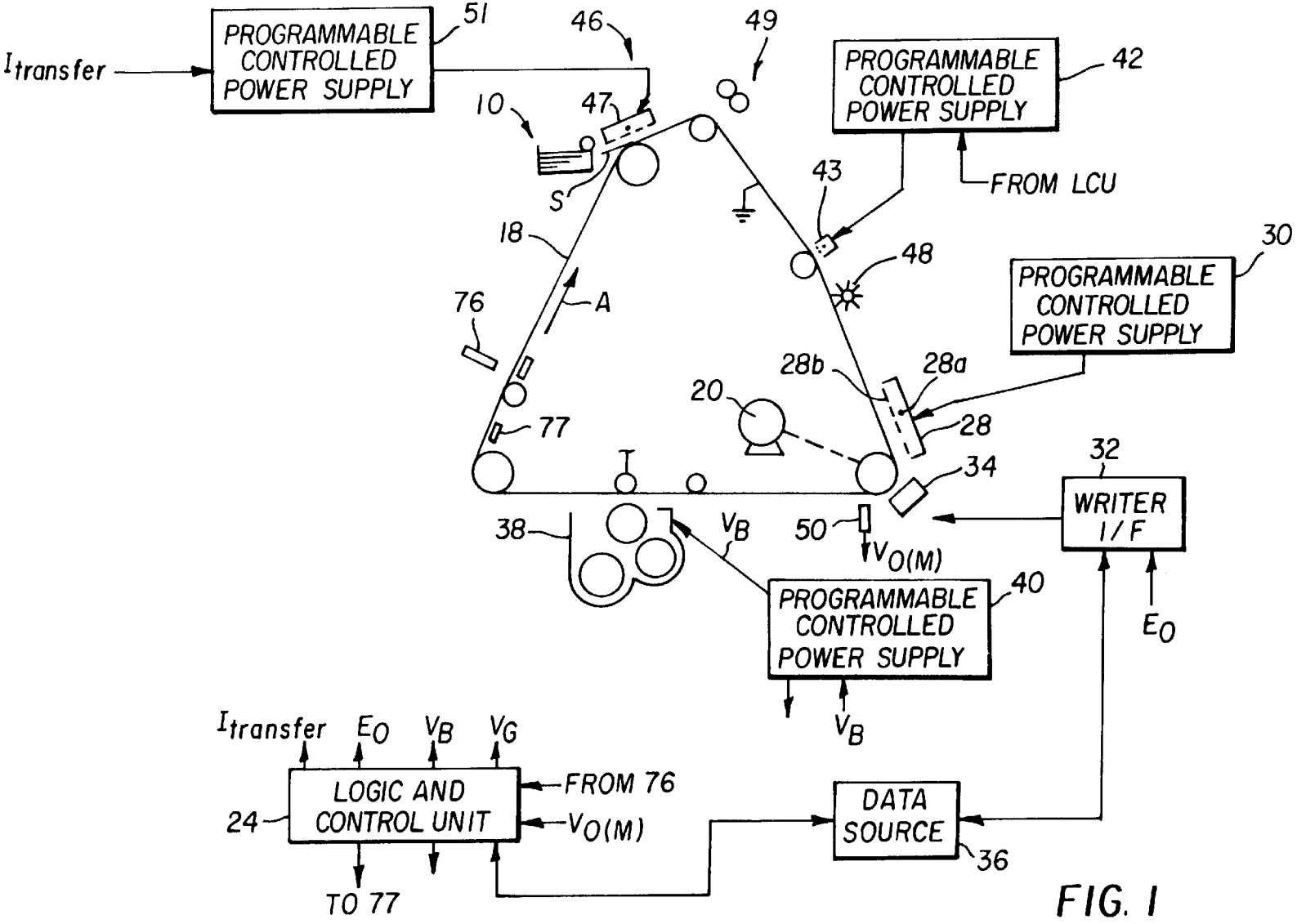
FIG. 1 is a side elevational view in schematic of an exemplary electrophoraphic recording apparatus in which the method of the present invention may be practiced.

With reference to the machine 10 as shown in FIG. 1, a moving image recording member such as photoconductive belt 18 is trained about a plurality of rollers, one of which is driven by a motor 20 to drive the belt 18 past a series of work stations of the printer. The recording member may also be in the form of a drum. As noted in the discussion provided above the photoconductive belt 18 may include one or more layers such as a photosensitive layer (CGL) and a CTL. Additionally, a ground layer or ground stripe is provided and an insulating support layer. A logic and control unit (LCU) 24, which has a digital computer, has a stored program for sequentially actuating the various work stations.

Briefly, a charging station sensitizes belt 18 by applying a uniform electrostatic charge of predetermined primary voltage $V_O$ to the surface of the belt. The output of the primary charger 28 at the charging station is regulated by a programmable controlled power supply 30, which is in turn controlled by LCU 24 to adjust primary voltage $V_O$ for example through control of electrical potential ($V_{GRID}$) to a grid electrode 28*b* that controls movement of charged ions, created by operation of the charging electrode wires 28*a*, to the surface of the recording member as is well known. In this example the grid wires 28*b* are electrically biased negatively to, for example, between −350 and −750 volts and a nominal bias might be −500 volts.

At an exposure station, projected light from a write head 34 modulates the electrostatic charge on the photoconductive belt to form a latent electrostatic image of a document to be copied or printed. The write head preferably has an array of light-emitting diodes (LEDs) or other light source such as a laser or other exposure source for exposing the photoconductive belt picture element (pixel) by picture element with an intensity regulated in accordance with signals from the LCU to a writer interface 32 that includes a programmable controller. Alternatively, the exposure may be by optical projection of an image of a document onto the photoconductor.

Where an LED or other electro-optical exposure source is used, image data for recording is provided by a data source 36 for generating electrical image signals such as a computer, a document scanner, a memory, a data network, etc. Signals from the data source and/or LCU may also provide control signals to a writer network, etc. Signals from the data source and/or LCU may also provide control signals to the writer interface 32 for identifying exposure correction parameters in a look-up table (LUT) for use in controlling image density. In order to form patches with density for process control purposes, the LCU may be provided with ROM memory or other memory representing data for creation of a patch that may be input into the data source 36.

Movement of belt 18 in the direction of the arrow A brings the areas bearing the latent electrostatographic charge images past a development station 38. The toning or development station has one (more if color) or more magnetic brushes in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with or a small spacing from the belt. The charged toner particles of the engaged magnetic brush are attracted imagewise to the latent image pattern to develop the pattern which includes development of the patches used for process control.

As is well understood in the art, conductive portions of the development station, such as conductive applicator cylinders, act as electrodes. The electrodes are connected to a variable supply of D.C. potential $V_B$ regulated by a programmable controller 40. Details regarding the development station are provided as an example, but are not essential to the invention.

In this example development will be according to a DAD process wherein negatively charged toner particles selectively develop into relatively discharged areas of the photoconductor. Other types of development stations are well known and may be used.

A transfer station 46, as is also well known, is provided for moving a receiver sheet S into engagement with the photoconductor in register with the image for transferring the image to a receiver sheet such as plain paper or a plastic sheet. Alternatively, an intermediate member may have the image transferred to it and the image may then be transferred to the receiver sheet. In the embodiment of FIG. 1, the transfer station includes a transfer corona charger 47. Electrostatic transfer of the toner image is effected with a proper voltage bias applied to the transfer charger 47 so as to generate a constant current as will be described below. The transfer charger in this example deposits a positive charge onto the back of the receiver sheet while the receiver sheet engages the toner image on the photoconductor to attract the toner image to the receiver sheet.

After transfer the receiver sheet may be detacked from the belt 18 using a detack corona charger (not shown) as is well known. A cleaning brush 48 or blade is also provided subsequent to the transfer station for removing toner from the belt 18 to allow reuse of the surface for forming additional images. To facilitate or condition remnant toner and other particles for removal by the brush 48 it is conventional to provide a charger device 43 to deposit, in this case, positive charge on the photoconductor to neutralize or reduce electrostatic adhesion of the remnant particles to the belt 18. The voltage to the charger is controlled by a power supply 42. While separate power supplies are shown for each charger it will be appreciated that one supply having multiple taps may be used in lieu of plural charger supplies. After transfer of the unfixed toner images to a receiver sheet, such sheet is transported to a fuser station 49 where the image is fixed.

The LCU provides overall control of the apparatus and its various subsystems as is well known. Programming commercially available microprocessors is a conventional skill well understood in the art. The following disclosure is written to enable a programmer having ordinary skill in the art to produce an appropriate control program for such a microprocessor. In lieu of only microprocessors the logic operations described herein may be provided by or in combination with dedicated or programmable logic devices. In order to precisely control timing of various operating stations, it is well known to use encoders in conjunction with indicia on the photoconductor to timely provide signals indicative of image frame areas and their position relative to various stations. Other types of control for timing of operations may also be used.

Process control strategies generally utilize various sensors to provide real-time control of the electrostatographic process and to provide "constant" image quality output from the user's perspective.

One such sensor may be a densitometer 76 to monitor development of test patches preferably in non-image areas of photoconductive belt 18, as is well known in the art, see in this regard U.S. application Ser. No. 08/998,787 filed in the names of Regelsberger et al.

A second sensor that is also desirably provided for process control is an electrostatic voltmeter 50. Such a voltmeter is preferably provided after the primary charger 28 to provide readings of measured $V_O$ or $V_{O(M)}$. Outputs of $V_{O(M)}$ and density read by densitometer 76 are provided to the LCU which in accordance with a process control program generates new set point values for $E_O$, $V_B$, $V_O$ and actuation of toner replenishment. Additionally, the process control may be used to adjust transfer current generated by the transfer charger 46 through adjustments to programmable power supply 51. A preferred electrometer is described in U. S. application Ser. No. 08/970,832 filed in the names of Stem et al.

As noted in the discussion above the requirement for certain chargers which output a charge of positive polarity with this photoconductor can create problems during set up. In this example, the chargers which provide a positive charge output are the transfer charger 47 and the preclean conditioning charger 43. The discussion below will be generally applicable to chargers that are required to apply charge that is of a polarity opposite to that which the photoconductor is suited to be charged. In setting up of such a charger a problem is presented to correctly position the charger so that there is front to back, i.e. cross-track, uniform positioning of the charger relative to the belt or web surface being charged. The cross-track direction is perpendicular to the process or in-track direction indicated by arrow A.

Figure 2:
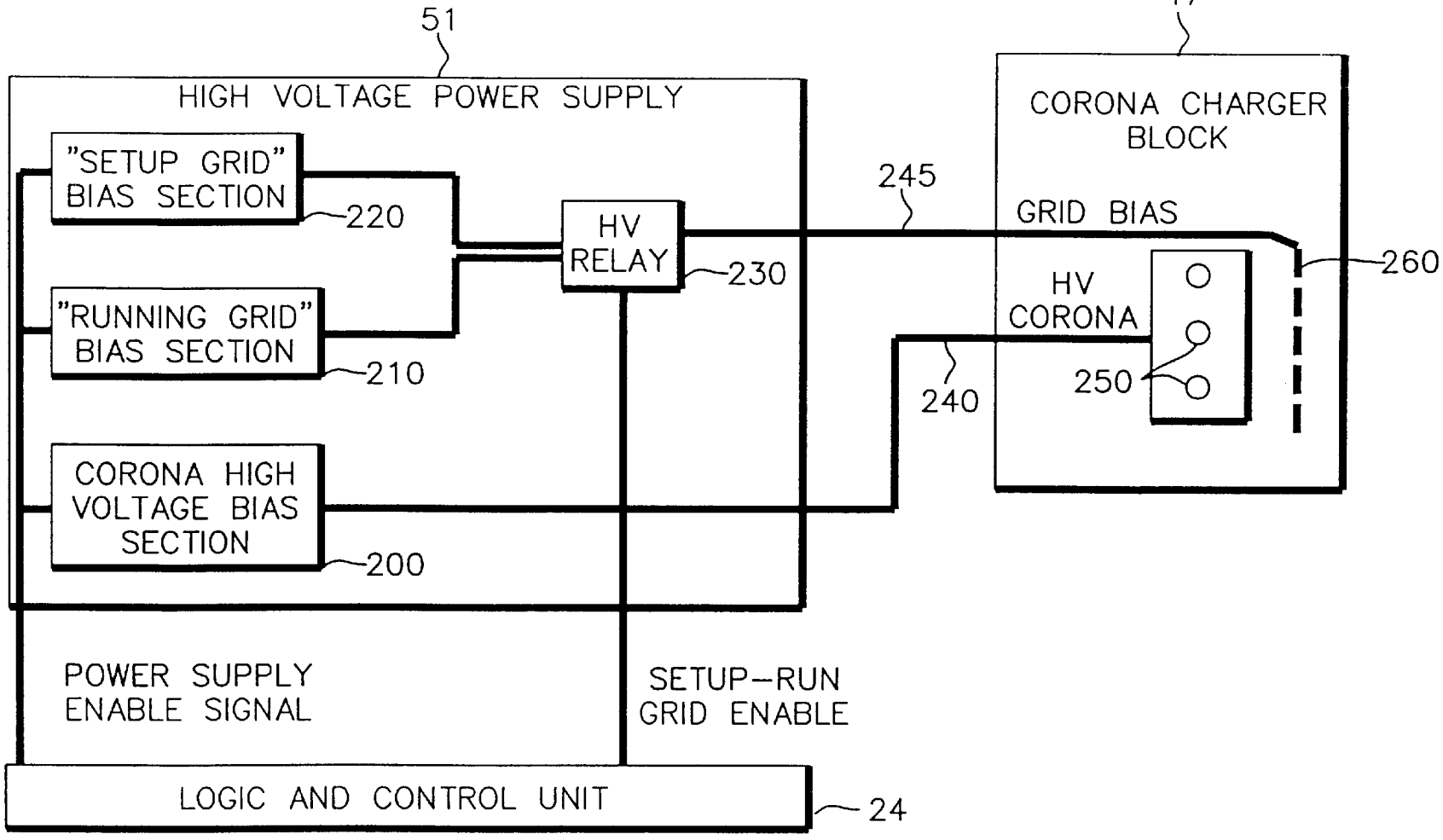
FIG. 2 is a schematic block diagram of a corona charger, power supply and logic and control unit as used in accordance with the method of the invention.

In its preferred embodiment this invention pertains to the setup of a corona charger which uses a biased grid to improve charge uniformity and is operated in a polarity opposite to that for which the photoconductive member was designed for use. To simplify the description, it will be assumed that the photoconductor being used is designed to be charged in the negative polarity. With reference to FIG. 2, the power supply 51 for the charger 47 comprises a high voltage section 200 to bias the corona wires 250 and two sections to bias the charger grid. One section 220 of the grid bias supply runs in the negative polarity and is used to set up the charger 47 to establish spacing uniformity and the other section 210 runs in the positive polarity and is used during normal machine operation. A means is provided by the control logic of the printer to select which polarity is used depending on the mode being run (normal print mode or setup mode). The means may include a high voltage relay 230 or other switching device.

If the setup mode is selected, the power supply 51 provides AC high voltage to the corona wires 250 and a grid voltage that is negative which charges the photoconductor to the negative polarity. The charger spacing is set up by charging the photoconductive member in the negative polarity using the setup grid bias 220, measuring the response with an electrostatic voltmeter 50, and erasing the voltage with an exposure device. The exposure device may be the writer or a light emitting erase bar which is well known. The electrostatic voltmeter can be placed in the normal service position and no special algorithms are needed to cycle components off and on to facilitate measurements.

If the normal run mode is selected, the power supply 51 provides AC high voltage to the corona wires 250 and a grid voltage in the positive polarity needed to facilitate the desired function in the running mode. Uniformity and spacing are assured through the setup done utilizing the setup mode grid voltage.

Readings for determining uniformity during set up are made by positioning the voltmeter at different cross-track positions to take readings of the charge on the belt at different cross-track locations on the belt 18. Position adjustments are made to the charger to assure uniform spacing of the corona electrodes to the belt 18.

The setup grid bias supply 220 provides DC power via electrical connecting line 245 to the charger grid 260 in the charger setup mode. In this mode, the grid is biased negatively to enable setup of the charger spacing to the photoconductive member. This section can be a fixed level output (no adjustment available) since it is only used to adjust spacing.

The run mode grid supply 210 provides DC power via electrical connecting line 245 to the charger grid during normal operation in the print or in the normal production mode. There is normally an adjustment available to change the magnitude of the grid bias in this mode. The adjustment of the magnitude of the grid can be used to compensate for changes in process requirements as needed.

The HV Relay 230 functions as a switch to provide connection of the charger grid to either the Setup or Run Mode Bias Supply. The state of this relay is controlled by the Logic and Control Unit 24.

The high voltage corona supply 200 provides power to excite the corona wires 250 and supply current to the photoconductive member to accomplish the charging function. Preferably the power to the corona wires is AC.

The setup of the charger spacing is accomplished as follows reference being made with regard to FIG. 3.

Figure 3:
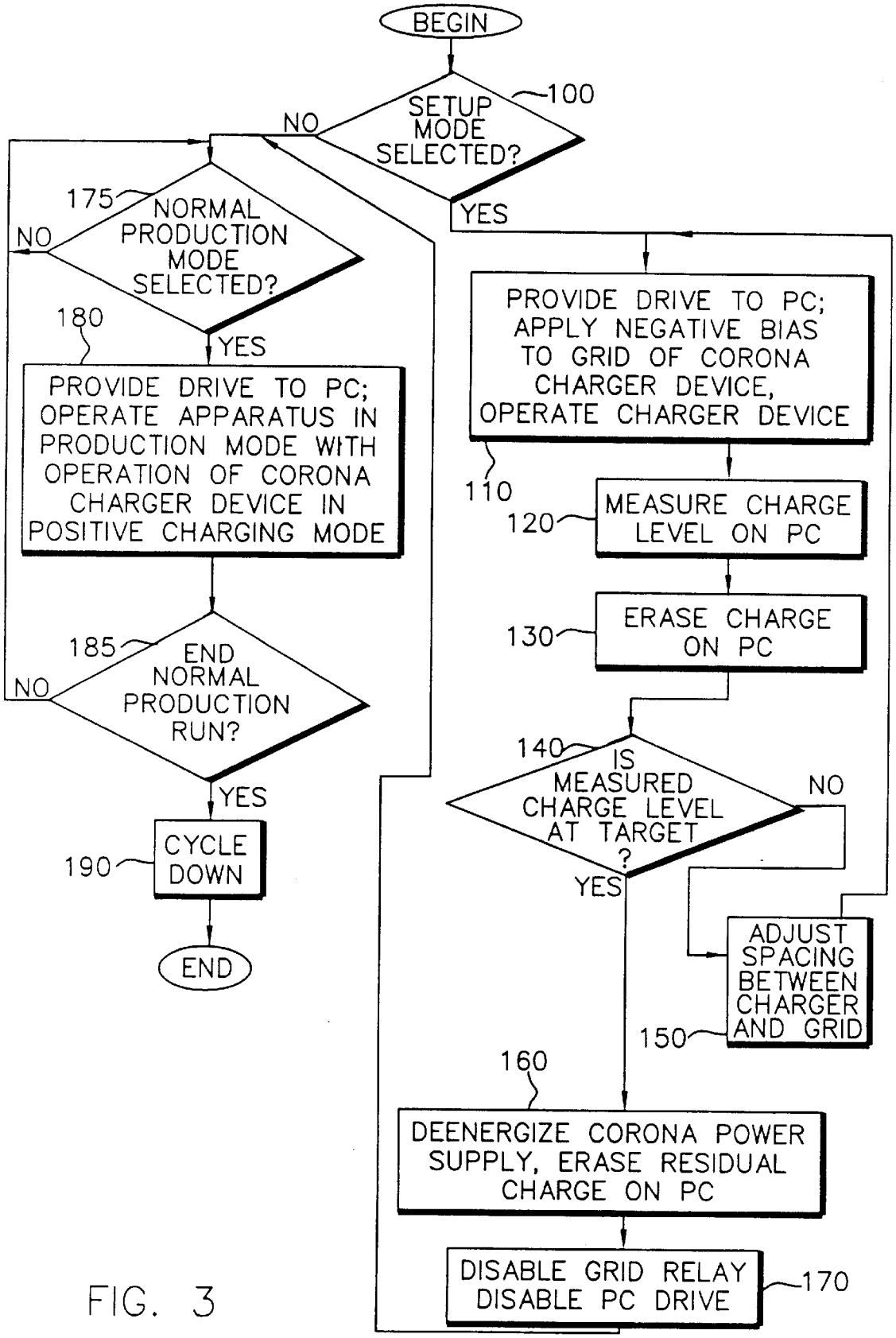
FIG. 3 is a flow chart illustrating operation of the method of the invention.

With reference to the flow chart of FIG. 3 a request for running the setup mode of the power supply is sent to the Logic and Control Unit (LCU) 24 for a service setup routine. If the setup mode is selected, step 100, the LCU enables the HV Relay to allow the grid on the corona charger 47 to be biased in the negative mode. This is the opposite mode from which the charger normally operates during production. The LCU enables the photoconductor drive system, the corona power supply 51 and the erase device 77 (FIG. 1), step 110. The erase device is an LED bar or EL panel and in this example is located after the development station for exposing the photoconductive layer of belt 18 through the belt's transparent support. Readings are taken by an electrostatic voltmeter, step 120, and the spacing of the charger 47 is adjusted until the proper target negative voltage is obtained on the photoconductive member, steps 130, 140 and 150. The target output negative voltage on the photoconductive member is predetermined to provide, when the charger is operated in the positive mode, the target output positive voltage of the charger. The target output negative voltage will be different from the target output positive voltage obtained when the charger is operating in the positive charging mode during normal production. However, through experiments it can be determined what negative target output voltage will provide a corresponding positive voltage when the grid bias is changed to a particular positive target output voltage biasing. Once the spacing is adjusted correctly, the corona power supply is de-energized and the residual charge on the photoconductor is erased using the erase bar, step 160. The final step is to turn off the HV Relay 230 and disable the photoconductor drive, step 170.

If the normal production run is selected, step 175, the normal run mode of the charger is enabled by turning on the corona power supply 200 with the HV Relay 230 in the disabled state. In this mode, the positive level for the charger grid is used to facilitate the positive charging function required of the charger in the print or normal production mode.

In the normal production mode drive is provided to the photoconductive belt 18, operation of the various stations is made to print copy sheets as described above, step 180, and transfer charging and/or preclean charging are provided using positive charging. Prints are made until the production run is over, step 185, and the apparatus cycles down, step 190.

Thus, in accordance with the invention, setup of the charger is simplified by running in a mode in which the photoconductor can be charged and erased without possibility of damage to the photoconductive member and no complex service routines to cycle charging components off and on to do the charger setup are required.

In addition, unique positioning of the electrostatic voltmeter probe at a particular location near the charger being setup is not required to correctly measure the charger output. The use of a simple, fixed output negative grid bias supply can be used to minimize added cost of the power supply to incorporate the setup feature. While the invention has been described with reference to corona chargers with grid it will be appreciated that the invention has advantages to other types of chargers. For example, the charger need not have a grid and may have its corona generating electrode powered positively in the production mode and negatively in the setup mode using suitable D.C. power sources. However, this is not preferred as it involves switching the high voltage section of the power supply. Other chargers use an electrically biased shield to control polarity of the charge depositing on the photoconductor and these may be also used in the method of the invention by controlling bias to the shield in the different modes.

Although, the description has been specifically described with reference to a transfer corona charger the invention is applicable to other corona chargers used in the electrophotographic process such as a preclean charger as noted above. Thus, the transfer corona charger 47 may be replaced by a transfer roller and the invention used with regard to setup of the preclean charger.

The invention has been described in detail with particular reference to certain preferred embodiments thereof, but it will be understood that variations and modifications can be effected within the spirit and scope of the invention.

What is claimed is:

1. A method for use in an electrophotographic recording apparatus having a photoconductive recording member, the method comprising:

operating a corona charger device in a calibration mode so that charge of a first polarity is output by the device and deposited upon the member;

sensing the level of charge deposited upon the member; and adjusting a position of the device relative to the member so that the level of charge deposited upon the member is at a target level;

operating the corona charger device during a production run mode so that a charge of a second polarity, opposite to that of the first polarity is output by the device and deposited upon the member or a receiver sheet in engagement with the member, wherein during the production run mode the device is operated to deposit substantially only charge of the second polarity upon the member or a receiver sheet in engagement with the member.

2. The method of claim 1 wherein a grid controls charge deposited upon the member or the receiver sheet and the grid is biased to the first polarity in the first mode and to the second polarity in the second mode.

3. The method of claim 2 and including erasing charge of the first polarity on the member before operating the corona charger device in the production ran mode.

4. The method of claim 1 and including erasing charge of the first polarity on the member before operating the corona charger device in the production run mode.

5. The method of claim 1 wherein the first polarity is negative charge and the second polarity is positive charge.

6. The method of claim 1 wherein during a production mode prints are produced.

7. The method of claim 1 wherein the photoconductive recording member includes a charge transport layer that is suited for transport of a charge carrier of one polarity only.

8. The method of claim 7 wherein a grid controls charge deposited upon the member or the receiver sheet and the grid is biased to the first polarity in the first mode and to the second polarity in the second mode.

* * * * *